US006203871B1

(12) United States Patent
Patil

(10) Patent No.: US 6,203,871 B1
(45) Date of Patent: Mar. 20, 2001

(54) ENCAPSULANT FOR LEADS IN AN AQUEOUS ENVIRONMENT

(75) Inventor: Girish Shivaji Patil, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/172,057

(22) Filed: Oct. 14, 1998

(51) Int. Cl.[7] ..... H01B 3/40

(52) U.S. Cl. ..... 428/35.8; 438/35.8; 438/68; 430/280.1; 522/103; 525/522; 525/523; 338/275

(58) Field of Search ..... 428/68, 344, 345, 428/555 EP, 413, 416, 418, 457, 35.8; 525/522, 523; 522/103–109; 338/275; 430/280.1

(56) References Cited

U.S. PATENT DOCUMENTS

| | | | |
|---|---|---|---|
| 4,090,936 | 5/1978 | Barton | 204/159.18 |
| 4,173,476 | 11/1979 | Smith et al. | 430/280 |
| 4,297,401 | 10/1981 | Chern et al. | 428/1 |
| 4,392,013 | 7/1983 | Ohmura et al. | 174/68.5 |
| 4,401,537 | 8/1983 | Chern et al. | 204/159.11 |
| 4,609,427 | 9/1986 | Inamoto et al. | 156/633 |
| 4,623,676 | 11/1986 | Kistner | 522/15 |
| 4,666,823 | 5/1987 | Yokota et al. | 430/320 |
| 4,688,053 | 8/1987 | Noguchi et al. | 346/140 R |
| 4,688,056 | 8/1987 | Noguchi et al. | 346/140 R |
| 4,775,445 | 10/1988 | Noguchi | 156/637 |
| 4,948,645 | 8/1990 | Holzinger et al. | 428/40 |
| 5,275,695 | 1/1994 | Chang et al. | 156/661.1 |
| 5,290,667 | 3/1994 | Shiba et al. | 430/328 |
| 5,334,999 | 8/1994 | Kashiwazaki et al. | 347/65 |
| 5,478,606 | 12/1995 | Ohkuma et al. | 427/555 |
| 5,578,417 | 11/1996 | Noguchi et al. | 430/280.1 |
| 5,707,780 * | 1/1998 | Lawton et al. | 430/280.1 |
| 5,907,338 | 5/1999 | Patil et al. . | |

FOREIGN PATENT DOCUMENTS

| | | |
|---|---|---|
| 0 432 795 A1 | 6/1991 | (EP) . |
| 03 084 026 | 4/1991 | (JP) . |
| 09 001 804 | 1/1997 | (JP) . |
| 09 024 614 | 1/1997 | (JP) . |

OTHER PUBLICATIONS

Detwent Abstract 1968–88419P, WR Grace.*
Cycloaliphatic Epoxides, Cyracure, Sep., 1995, p. 13, Union Carbide Corp., Danbury, CT.

* cited by examiner

*Primary Examiner*—Rena L. Dye
*Assistant Examiner*—Sow-Fun Hon
(74) *Attorney, Agent, or Firm*—John A. Brady

(57) ABSTRACT

An article, specifically an inkjet printhead, having electrical leads in an aqueous environment in which the leads are encapsulated in a thoroughly cured mixture of 88 parts bis-phenol A epoxy oligomer, 11 parts epoxy novolac oligomer, and 1 part triarylsulfonium hexafluoroantimonate salts. No special atmosphere is required during manufacture and the uncured mixture has a long pot life. The cured mixture has excellent resistance to an aqueous environment.

6 Claims, No Drawings

ENCAPSULANT FOR LEADS IN AN AQUEOUS ENVIRONMENT

TECHNICAL FIELD

This invention relates to encapsulating electrical leads on an inkjet printhead or other aqueous environment.

BACKGROUND OF THE INVENTION

In the production of a thermal inkjet print cartridge, a printhead is bonded to the flexible tab circuit by means of either wire bonds or tab bonds. These exposed bonds have to be protected against possible mechanical damage and possible chemical damage (due to contact with inks). An encapsulant material ideal for use in an inkjet print cartridge should have very good adhesion to tab circuit material (both polymeric and metal) and very good chemical resistance. This need is met by the present invention.

DISCLOSURE OF THE INVENTION

An encapsulant currently in use, UV 9000 from Emerson and Cuming, is a urethane acrylate system and uses a free radical cure mechanism. This presents an inherent problem. One has to take extra precaution to ascertain that the atmosphere is inert before initiating the cure. In addition, this system is incapable of continuing the cure once the light source has been removed. This sometimes results in leaving uncured material in deeper areas and shadowed areas where the ultra violet (UV) light has been unable to reach.

Many of the commercially available encapsulant materials use a free radical cure mechanism which will have similar disadvantages. Known commercially available materials do not have good chemical resistance to aqueous inks.

The encapsulant material in the present invention uses a cationic cure mechanism. This instantly solves one problem. The need for an inert atmosphere is no longer necessary. In addition, this system is capable of continuing the cure once the source of light has been removed. Some of the other positive attributes of this system are long shelf life (months/years) and a very good pot life (days). A chemical resistance study indicates that this system has very good resistance toward aqueous inks such as the inkjet inks sold by the assignee of this invention. This study was carried out for eight weeks at 60° C.

DISCLOSURE OF THE INVENTION

Electrical leads of an apparatus in an aqueous environment are encapsulated in a thoroughly cured mixture substantially as follows, by weight:

88% bis-phenol A epoxy oligomer;

11% epoxy novolac oligomer; and

10% hexafluoroantimonate salts (as an ultraviolet cure initiator).

In application, the mixture requires no special atmospheres and has a long pot life. In use the cured mixture has excellent resistance in an aqueous environment.

DESCRIPTION OF THE PREFERRED EMBODIMENTS

The encapsulant composition preferred in this invention has three (3) components as follows, as well as their amount by percent of weight.

| | % of Weight |
|---|---|
| Bis-phenol A epoxy oligomer resin (Epon 828, product of Shell Chemical Company) | 88% |
| Epoxy novolac oligomer resin (D.E.N. 431, product of Dow Chemical Company) | 11% |
| Mixed triarylsulfonium hexafluoroantimonate salts (UVI-6974, product of Union Carbide) | 1% |

Structural formulas of the materials are as follows:

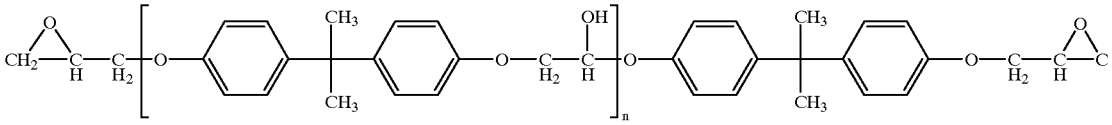

Epon 828: n = 0.15
Bis-Phenol A based Epoxy Resin

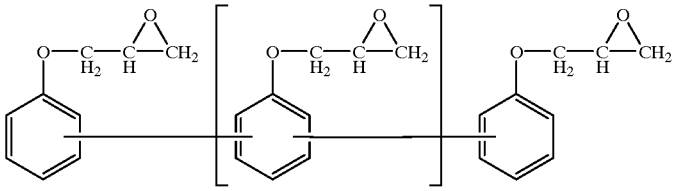

D.E.N. 431: n = 0.2
Epoxy Novolac Resin

-continued

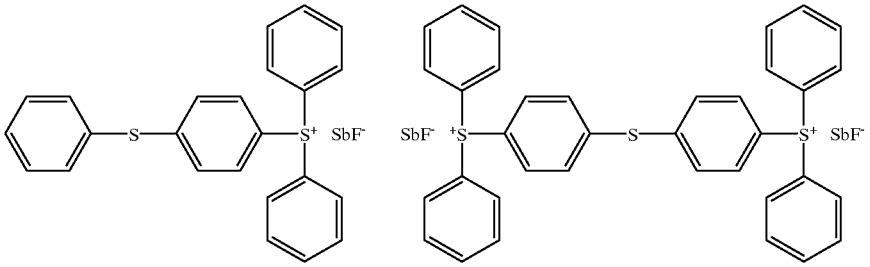

Cyracure UVI-6974
Mixed Triarylsulfonium Hexafluoroantimonate Salts

This material readily mixes with stirring. The mixture is then applied to tab bond electrical leads on an inkjet printhead during manufacture of the complete printhead. The material is not highly viscous and therefore may be applied by a variety of known techniques such as by brush or by injection from a needle.

The printhead with the mixture surrounding the leads is then exposed to UV light of intensity of about 7 watts/cm$^2$ for 8 seconds, followed by 45 minutes bake at 100° C. This completes a thorough cure of the mixture, which then encapsulates the leads to protect them from contamination.

Because of the location of the leads near ejection nozzles on an inkjet printhead, some ink will from time to time contact the cured mixture. The ink is water-based, containing dyes or pigments and some organic solvent. The cured mixture is strongly resistant to deterioration from such an aqueous environment.

Patent protection is sought in the broadest scope provided by law, with particular reference to the accompanying claims.

What is claimed is:

1. An article of manufacture having an electrical lead in a liquid aqueous environment, said lead being encapsulated in a thoroughly cured mixture substantially as follows by weight:

88% bis-phenol A epoxy oligomer;

11% epoxy novolac oligomer; and

1% ultra violet cure initiator.

2. The articles as in claim 1 in which said initiator is hexafluoroantimonate salts.

3. The article as in claim 2 in which said epoxy oligomer is

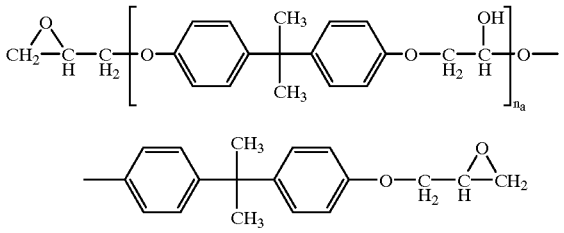

and said novolac oligomer is

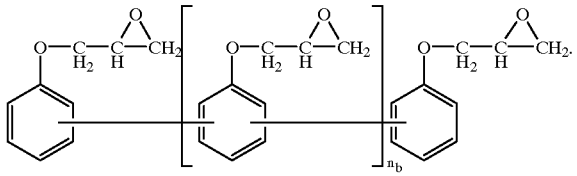

4. The article as in claim 3 in which said hexafluoroantimonate salts is a mixture triarylsulfonium hexafluoroantimonate salts.

5. The article in claim 3 in which $n_a$ is about 0.15 and $n_b$ is about 0.2.

6. The article in claim 4 in which $n_a$ is about 0.15 and $n_b$ is about 0.2.

* * * * *